US006456018B1

(12) United States Patent
Bae et al.

(10) Patent No.: US 6,456,018 B1
(45) Date of Patent: Sep. 24, 2002

(54) ELECTRON GUN FOR COLOR CATHODE RAY TUBE

(75) Inventors: Min-cheol Bae; Young-gon Hong, both of Suwon (KR)

(73) Assignee: Samsung SDI Co., LTD, Kyungki-Do (KR)

( * ) Notice: Subject to any disclaimer, the term of this patent is extended or adjusted under 35 U.S.C. 154(b) by 0 days.

(21) Appl. No.: 09/839,593

(22) Filed: Apr. 23, 2001

(30) Foreign Application Priority Data

Aug. 22, 2000 (KR) ..... 00-48541

(51) Int. Cl.[7] ..... G09G 1/04
(52) U.S. Cl. ..... 315/382; 315/382.1; 313/414
(58) Field of Search ..... 315/382, 382.1, 315/364; 313/414, 412, 413

(56) References Cited

U.S. PATENT DOCUMENTS 4,814,670 A 3/1989 Suzuki et al. ..... 315/15
5,027,043 A 6/1991 Chen et al. ..... 315/368
5,739,631 A * 4/1998 Tojyou et al. ..... 313/412
6,031,346 A * 2/2000 Shirai et al. ..... 313/414

* cited by examiner

*Primary Examiner*—Don Wong
*Assistant Examiner*—Tuyet T. Vo
(74) *Attorney, Agent, or Firm*—Leydig Voit & Mayer, Ltd.

(57) ABSTRACT

An electron gun for a color cathode ray tube includes cathodes, a control electrode, and a screen electrode, forming a triode, first, second, third, and fourth focusing electrodes, sequentially arranged relative to the screen electrode and forming at least one first quadrupole lens, fifth and sixth focusing electrodes, adjacent to the fourth focusing electrode and forming at least one second quadrupole lens, and a final accelerating electrode, adjacent to the sixth focusing electrode and forming a main lens.

8 Claims, 5 Drawing Sheets

ELECTRON GUN FOR COLOR CATHODE RAY TUBE

BACKGROUND OF THE INVENTION

1. Field of the Invention

The present invention relates to an electron gun for a color cathode ray tube (CRT), and more particularly, to a dynamic focus electron gun for a color CRT having improved electron beam apertures, arranged in an in-line arrangement and forming a quadrupole lens.

2. Description of the Related Art

In general, an electron gun for a color cathode ray tube (CRT), installed on a neck portion of the CRT, emits thermal electrons. The performance of a CRT is influenced by a state in which electron beams land on a phosphor screen. Thus, various types of electron guns which can improve focusing characteristics so that electron beams emitted from the electron gun accurately land on a focus of a phosphor screen, and can reduce aberration of an electronic lens, have been developed. In particular, in order to reduce the electric length of a CRT, recently, the deflection angle of the CRT has been made larger and the length of the electron gun has decreased. In this case, the focused length of an electron beam landing on a central portion of the phosphor screen is relatively longer than that of an electron beam landing on a peripheral portion of the phosphor screen, so that the focusing characteristics of electron beams in the periphery of the screen become deteriorated.

Also, since the distortion of an electron beam increases exponentially as the angle of incidence of the electron beam with respect to the phosphor screen is reduced, the beam spot diameter of the electron beam landing on the phosphor screen becomes larger. An in-line color CRT based on self-convergence includes a deflection yoke for forming a non-homogenous magnetic field for deflecting electron beams emitted from an electron gun. The electron beams emitted from the electron gun are converged throughout the whole screen by beam concentration by a main lens installed in the electron gun and a nonuniform magnetic field produced by a horizontal deflection magnetic field of a pincushion shape and a vertical deflection magnetic field of a barrel shape.

As described above, the electron beams traveling the nonuniform magnetic field are subject to both an astigmatism and a deflection force in a direction in which the beams are vertically over-focused, as shown in FIG. 8.

An example of an electron gun for a color CRT for solving the above-mentioned problem is disclosed in U.S. Pat. No. 4,814,670.

The disclosed electron gun, as shown in FIG. 1, has three electron beam through-holes 12 which are oblong in a vertical direction and located on an entrance face of a first focusing grid 11, forming a quadrupole lens. Also, a horizontally elongated electron beam through-hole 14 which three electron beams commonly pass through and located on an exit face of a second focusing grid 13, opposing the first focusing grid 11, forms the quadrupole lens. A focusing voltage VF, which is a static voltage, is applied to the first focusing grid 11 and a dynamic voltage VD, which is synchronized with a deflection signal, is applied to the second focusing grid 13.

Since the aforementioned conventional electron gun has a single horizontally elongated electron beam through-hole 14 in the second focusing electrode 13, the intensities of the electronic lens formed by the first and second focusing grids

11 and 13, that is, magnifications, are different from each other at the central portion and either side of the electronic lens. Thus, the spot sizes of electron beams landing on left and right sides of the screen become different. In particular, since one single electron beam through-hole 14, which is elongated in a horizontal direction, is located at the second focusing grid 13, assembly of an electron gun using a zig is quite difficult. Also, since vertical focusing power becomes relatively weak due to the horizontally elongated electron beam through-hole 14 at the entrance face of the second focusing grid 13 in the course of forming the quadrupole lens, a higher dynamic voltage should be applied to the grids for attaining a predetermined vertical focusing power.

Another example of a conventional electron gun is disclosed in U.S. Pat. No. 5,027,043.

The disclosed electron gun includes means for diverting an electron beam from a straight line path. The beam diverting means is used as part of a quadrupole lens for correcting astigmatism introduced by an associated self-converging yoke. The quadrupole lens is constructed such that different voltages are applied to the electrodes having vertically elongated electron beam apertures or horizontally elongated electron beam apertures.

The above-described electron gun can statically converge three electron beams arranged inline and can correct the cross section due to vertical and horizontal deflection magnetic fields for deflecting electron beams. A difference in the focal distance between the periphery and center of a screen is increased and the astigmatism due to a deflection yoke increases. The CRT can have a wide angle of deflection and be flattened, but the electron gun requires a stronger power for correcting the astigmatism and focal distance distance.

In order to attain a stronger power for correcting astigmatism, there must be a large difference in the potential applied between electrodes which form a quadrupole lens. Also, since a stronger power for correcting focal distance in the screen periphery is necessary, higher voltages must be generated at the screen periphery. However, the necessity of higher voltages causes problems of circuit reliability and voltage resistance. Also, in the case where an electron beam is incident into the screen periphery, a horizontal halo may undesirably increase at the screen periphery due to a horizontally decreased, vertically increased angle of incidence of the electron beam by the horizontally convergent, vertically divergent action of the quadrupole lens close to a main lens.

In order to compensate for distortion of a beam at the periphery of the CRT having a wide angle of deflection at a low voltage, it is necessary to constitute a quadrupole lens sensitive to voltage. To this end, the electron beam holes, which form the quadrupole lens, are more effectively made smaller. However, if the electron beam holes are smaller than those of other assembled electrodes, in view of the characteristic of an electron gun assembling process using electron beam holes, the assembling process becomes difficult, and the precision and manufacturing process are undesirably complicated.

SUMMARY OF THE INVENTION

To solve the above problems, it is an object of the present invention to provide an electron gun for a color cathode ray tube, which can prevent spots of electron beams landing on the periphery of a phosphor screen by making the angle of deflection wider, can compensate for distortion of the cross section of an electron beam due to deflection magnetic field of a deflection yoke, and can improve assembling efficiency.

It is another object of the present invention to provide an electron gun for a color cathode ray tube, which can improve the resolution at the periphery of a phosphor screen by improving focusing characteristics of electron beams and can improve voltage resistance and reliability.

To accomplish the first object of the present invention, there is provided an electron gun for a color cathode ray tube including cathodes, a control electrode and a screen electrode, forming a triode, first, second, third and fourth focusing electrodes, sequentially installed from the screen electrode and forming at least one first quadrupole lens, fifth and sixth focusing electrodes, installed adjacent to the fourth focusing electrode and forming at least one second quadrupole lens, and a final accelerating electrode, installed adjacent to the sixth focusing electrode and forming a main lens.

In the present invention, the first quadrupole lens is constructed such that horizontally elongated electron beam holes are formed on the exit side of the third focusing electrode, and vertically elongated electron beam holes are formed on the entrance side of the fourth focusing electrode.

The second quadrupole lens is constructed such that horizontally elongated electron beam holes are formed on the exit side of the fourth focusing electrode, vertically elongated electron beam holes are formed on the fifth focusing electrode and circular electron beam holes formed on the entrance side of the sixth focusing electrode. Also, the second quadrupole lens is constructed such that horizontally elongated electron beam holes are formed on the exit side of the fourth focusing electrode, vertically elongated electron beam holes are formed on the fifth focusing electrode and vertically elongated electron beam holes are formed on the entrance side of the sixth focusing electrode.

According to another aspect of the present invention, there is provided an electron gun for a color cathode ray tube including cathodes, a control electrode and a screen electrode, forming a triode, first and second focusing electrodes sequentially installed from the screen electrode, a third focusing electrode having horizontally elongated electron beam holes formed on its exit side, and fourth focusing electrode having vertically and horizontally elongated electron beam holes formed on its entrance and exit sides, respectively, and a fifth focusing electrode, installed adjacent to the fourth focusing electrode and having vertically elongated electron beam holes, and a final accelerating electrode installed adjacent to the fifth focusing electrode, the fifth focusing electrode and the final accelerating electrode forming a main lens, wherein a static voltage is applied to the screen electrode and the second focusing electrode, a focus voltage is applied to the first, third and fifth focusing electrodes, a parabola dynamic focus voltage, synchronized with a deflection signal, is applied to the fourth focus electrode and a sixth focusing electrode.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENT

Figure 1:
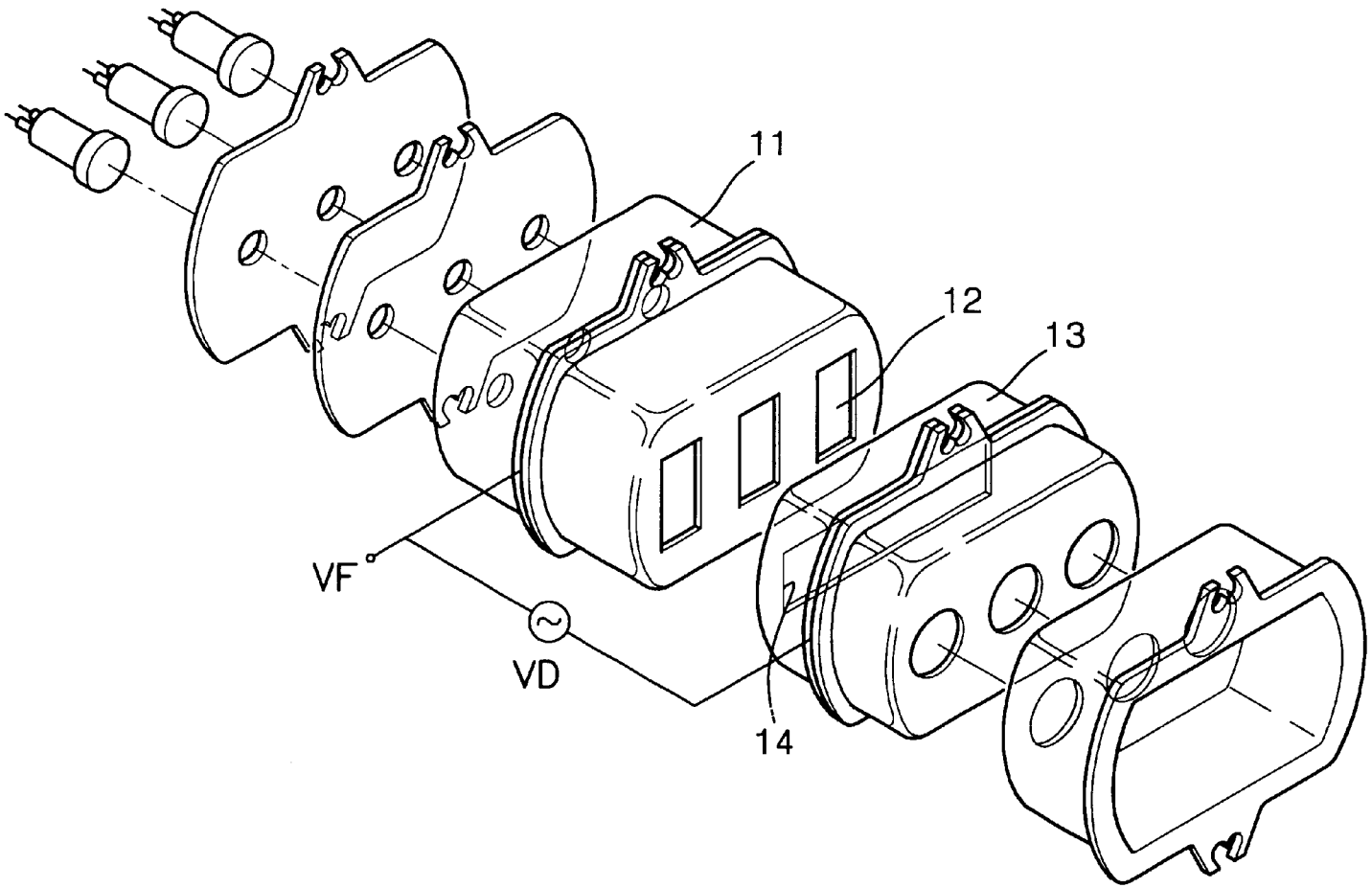
FIG. 1 (PRIOR ART)
FIG. 1 is a perspective view illustrating a conventional electron gun for a color cathode ray tube.
Figure 2:
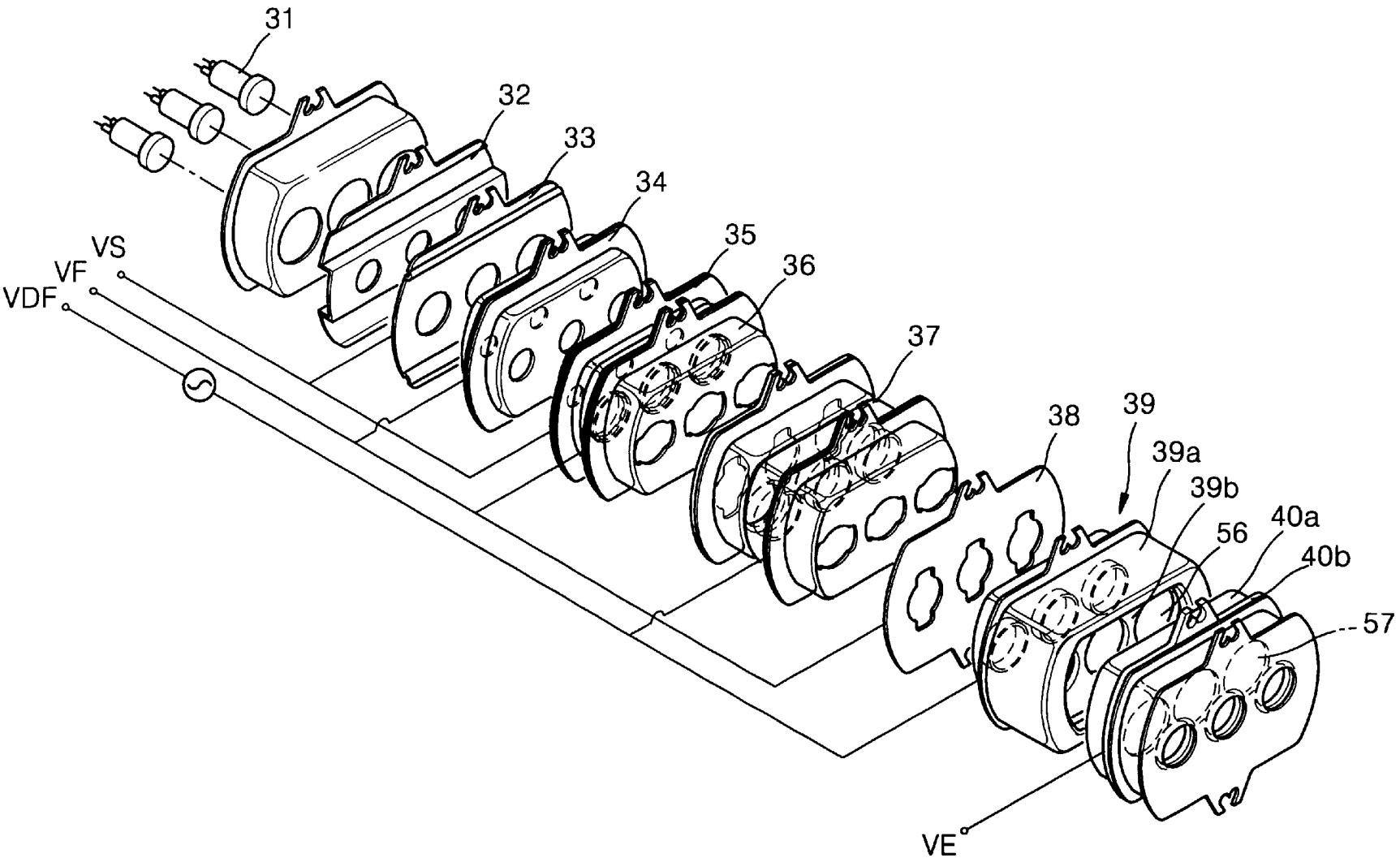
FIG. 2 is a perspective view of an electron gun for a color cathode ray tube, illustrating the state in which voltages are applied.

FIG. 2 is a perspective view of an electron gun for a color cathode ray tube, illustrating the state in which voltages are applied.

As shown in FIG. 2, an electron gun includes three inline cathodes 31, a control electrode 32 and a screen electrode 33, which form a triode, first, second, third, and fourth focusing electrodes 34–37, which are arranged, in sequence, from the screen electrode 33 and which form at least one first quadrupole lens, fifth and sixth focusing electrodes 38 and 39, which are located adjacent to the fourth focusing electrode 37 and which form a second quadrupole lens, and a final accelerating electrode 40, which is located adjacent to the sixth focusing electrode 39 and which forms a main lens.

Figure 3:
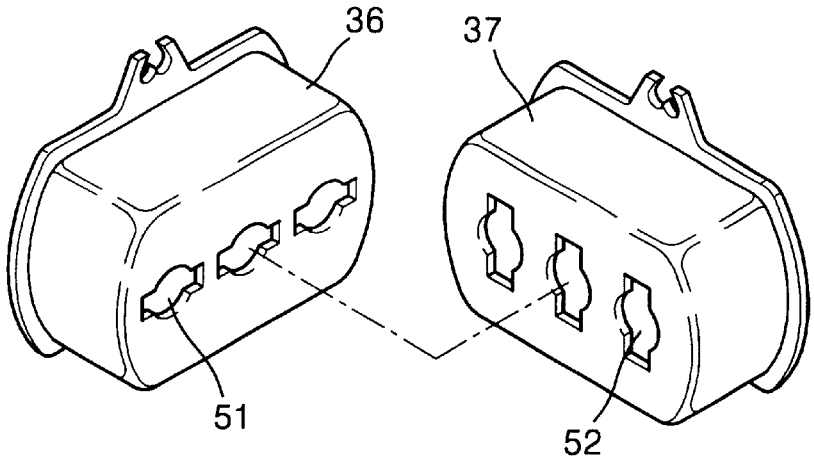
FIG. 3 is an extracted perspective view of electrodes for forming a first quadrupole lens.
Figure 4:
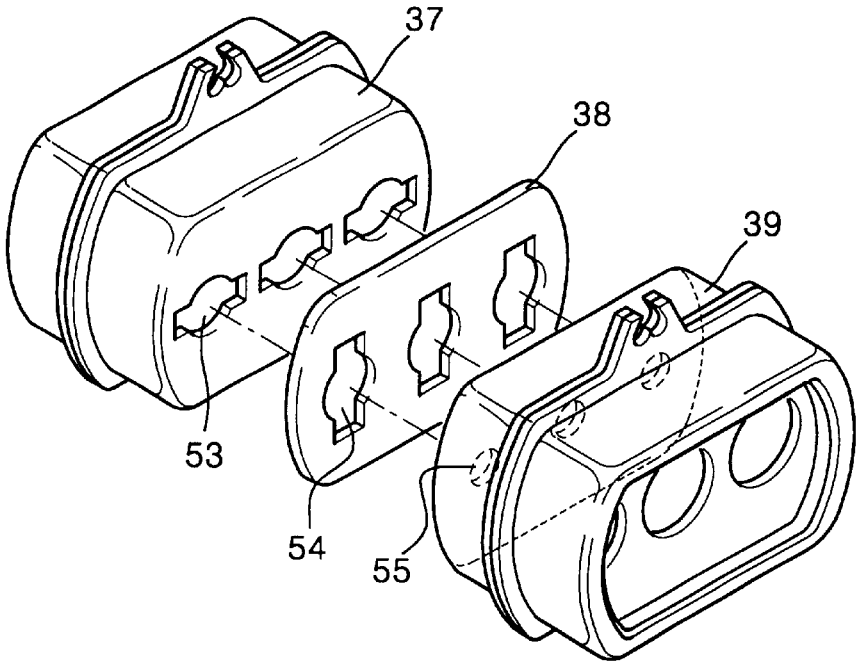
FIG. 4 is an extracted perspective view of electrodes for forming a second quadrupole lens.

Three independent electron beam holes, or a large electron beam hole through which all of three electron beams pass, for forming an electronic lens, are formed on each of the respective electrodes forming the electron gun. As shown in FIG. 3, horizontally elongated electron beam holes 51 are formed on the exit side of the third focusing electrode 36 and vertically elongated electron beam holes 52 are formed on the entrance side of the fourth focusing electrode 37, thereby forming the first quadrupole lens. Also, as shown in FIG. 4, horizontally elongated electron beam holes 53 are formed on the exit side of the fourth focusing electrode 37 which forms the second quadrupole lens, vertically elongated electron beam holes 54 are formed on the entrance side of the fifth focusing electrode 38 and circular electron beam holes 55 are formed on the entrance side of the sixth focusing electrode 39.

The vertically and horizontally elongated electron beam holes are shaped such that recessed portions of a predetermined depth are formed at upper and lower portions of and both sides of the circular electron beam holes, producing keyhole-shaped electron beam holes, as shown, and are not limited thereto. For example, rectangular or elliptical electron beam holes may be formed.

Figure 5:
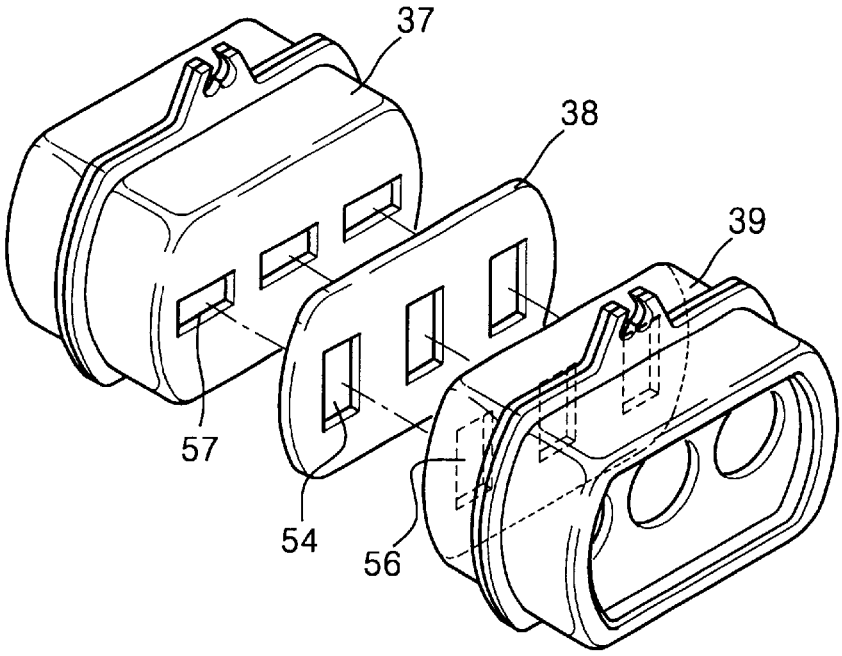
FIGS. 5 and 6 are perspective views illustrating other examples of electrodes for forming the second quadrupole lens.
Figure 6:
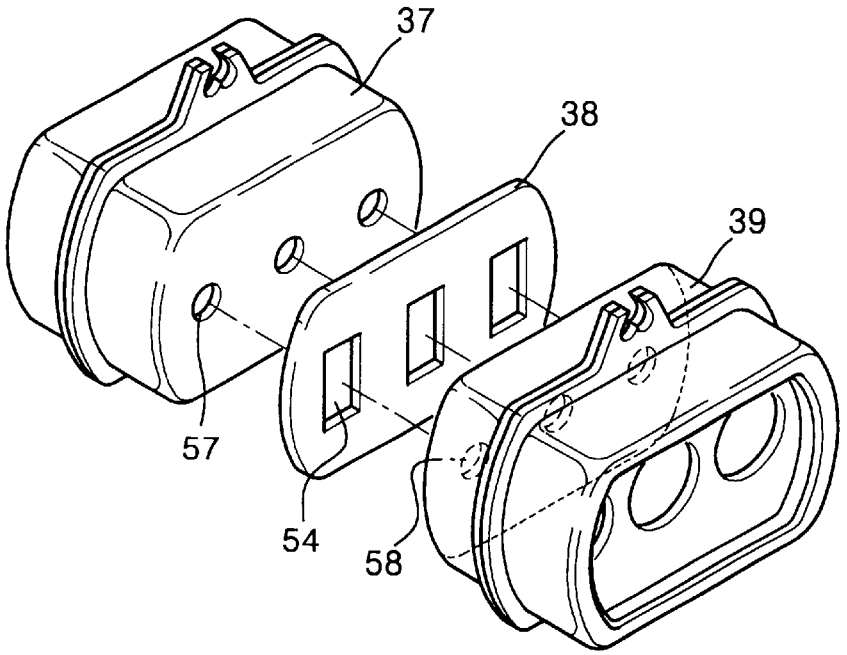

In order to form the second quadrupole lens, as shown in FIG. 5, horizontally elongated electron beam holes 57 may be located on the exit side of the fourth focusing electrode 37 and vertically elongated electron beams 54 and 56 may be located on the fifth focusing electrode and on the entrance side of the sixth focusing electrode 39. Also, in order to form the second quadrupole lens, according to another embodiment of the present invention, as shown in FIG. 6, circular electron beam holes 57 and 58 may be located on the exit side of the fourth focusing electrode 37 and on the entrance side of the sixth focusing electrode 39, respectively, and vertically elongated electron beam holes 54 may be located on the fifth focusing electrode 38.

The exit side of the sixth focusing electrode 39 and the entrance side of the final accelerating electrode 40, forming the main lens, as shown in FIG. 2, consist of outer rim electrode members 39*a* and 40*a* each having a large electron beam hole, and plate-shaped inner electrode members 39*b* and 40*b* installed inside the outer rim electrode members 39*a* and 40*a* and having three separate electron beam holes 56 and 57 formed thereon.

A predetermined voltage is applied to each of the respective electrodes having the aforementioned configuration, which will now be described.

A predetermined static voltage VS is applied to the screen electrode 34 and the second focusing electrode 35, a focus voltage VF higher than the static voltage VS is applied to the first, third and fifth focusing electrodes 34, 36 and 38. A parabola dynamic focus voltage VDF synchronized with a deflection signal is applied to the fourth and sixth focusing electrodes 37 and 39, and a high anode voltage VE is applied to the final accelerating electrode 40. The anode voltage VE ranges from 28 to 35 kV. The focus voltage VF is approximately 28% the anode voltage VE. The dynamic focus voltage VFD is approximately 28+3% the anode voltage VE having the focus voltage VF as a base vdoltage.

The function of a dynamic focus electron gun for a color CRT according to the present invention will now be described.

First, as a predetermined potential is applied to electrodes forming the electron gun for a color CRT, electronic lenses are formed between each of the respective electrodes by electric power lines and equipotential lines, which will now be described in the cases where electron beams are scanned on the center of the phosphor screen and on the periphery of the phosphor screen, respectively.

When electron beams are scanned on the center of the phosphor screen, the dynamic focus voltage VFD having the focus voltage VF as a base voltage is not applied. Thus, a pre-focusing electrode is formed between the screen electrode 33 and the first focusing electrode 34, and an auxiliary lens is formed between the second and third focusing electrodes 35 and 36. A main lens is formed between the sixth focusing electrode 39 and the final accelerating electrode 40.

Thus, the electron beams emitted from the cathodes 31 are pre-focused and accelerated by the pre-focusing lens and are then finally focused and accelerated by the main lens to land on the center of the phosphor screen.

Figure 7:
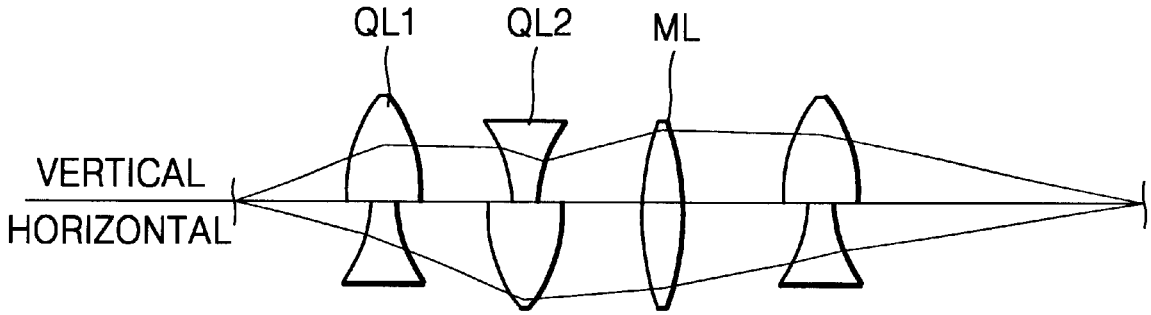
FIG. 7 is a diagram envisaging an electronic lens formed among electrodes when electron beams emitted from an electron gun are scanned onto the periphery of a phosphor screen.
Figure 8:
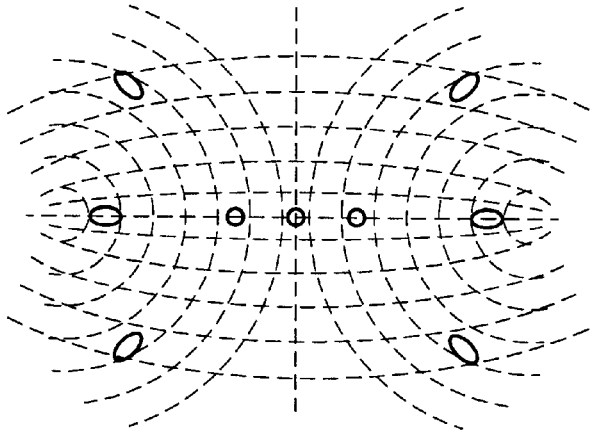
FIG. 8 is a graph showing the distribution of a magnetic field based on nonuniform deflection magnetic field and beam distortion caused thereby.

When electron beams are scanned on the periphery of the phosphor screen, the dynamic focus voltage VFD synchronized with a deflection signal is applied to the fourth focusing electrode 37 and the sixth focusing electrode 39. Thus, as shown in FIG. 7, a pre-focusing electrode is formed between the screen electrode 33 and the first focusing electrode 34, and an auxiliary lens is formed between the first and second focusing electrodes 34 and 35 by electric power lines and equipotential lines by the focus voltage VF and the static voltage VS. A first quadrupole lens QL1 is formed between the third and fourth focusing electrodes 36 and 37, and a second quadrupole lens QL2 is formed between each of the fourth, fifth and sixth focusing electrodes 37, 38 and 39. Also, a main lens ML, which has a relatively weaker magnification according to application of the dynamic focus voltage VFD, is formed between the sixth focusing electrode 39 and the final accelerating electrode 40.

In the state in which the electron lens is formed as described above, the electron beams emitted from the cathodes 31 are pre-focused and accelerated while passing through the pre-focusing lens and the auxiliary lens, and then pass through the first quadrupole lens QL1. The first quadrupole lens QL1 is formed by the horizontally elongated electron beam holes 51 formed on the exit side of the third focusing electrode 36 and the vertically elongated electron beam holes 52 formed on the entrance side of the fourth focusing electrode 37. Also, the dynamic focus voltage VDF, which is relatively high, is applied to the fourth focusing electrode 37. Thus, a convergent lens is formed in a vertical direction and a divergent lens is formed in a horizontal direction. Thus, the electron beams passing through the lenses are subjected to a vertically converging power and a horizontally diverging power.

As described above, the converged and diverged electron beams pass through the second quadrupole lens formed by the fourth, fifth and sixth electrodes 37, 38 and 39. In the second quadrupole lens, since the horizontally elongated electron beam holes 53 are formed on the exit side of the fourth focusing electrode 37, the vertically elongated electron beam holes 54 are formed on the entrance side of the fifth focusing electrode 38 and the dynamic focus voltage VDF synchronized with a deflection signal is applied to the sixth focusing electrode 39, a divergent lens is formed in a vertical direction and a convergent lens is formed in a horizontal direction. Thus, the vertical electron beams, converged while passing through a convergent lens unit constituting the first quadrupole lens QL1, have a reduced angle of incidence onto a divergent lens unit constituting the second quadrupole lens QL2, to then pass through the center of the divergent lens unit. Also, the horizontal electron beams, diverged while passing through a divergent lens unit constituting the first quadrupole lens QL1, pass through the periphery of a convergent lens unit constituting the second quadrupole lens QL2, thereby being subjected to relatively larger spherical aberration. Thus, the cross sections of the electron beams having passed through the second quadrupole lens QL2 are vertically elongated.

The electron beam having a vertically elongated cross section passes through the main lens formed by the sixth focusing electrode 39 and the final accelerating electrode 40. Since the dynamic focus voltage VDF is applied to the sixth focusing electrode 39, a difference between the voltages applied to the final accelerating electrode 40 and the sixth focusing electrode 39 is reduced, thereby forming a main lens having a relatively weak magnification. Thus, the electron beam passing through the main lens is subjected to relatively weaker spherical aberration and the focal distance increases. The vertically elongated electron beam is deflected by a nonuniform deflection magnetic field DL to then land on the periphery of the phosphor screen.

The electron beam landing on the phosphor screen reduces a difference in the exit angle of electron beams passing through the divergent and convergent lens units formed by the first quadrupole lens, thereby compensating for a difference in the incidence angle of electron beams landing on the periphery of the screen by the divergent and convergent lens units formed by the second quadrupole lens. Therefore, the distortion of electron beams due to a difference in the convergence angle of the electron beams and deflection magnetic field can be compensated for by the main lens and the first and second quadrupole lenses QL1 and QL2.

Among the electron beam holes forming the first and second quadrupole lenses QL1 and QL2, circular electron beam holes are located on the entrance side of the sixth focusing electrode 39. Thus, the quadrupole lens is subjected to vertically converging power and has a vertically increasing angle of divergence and a horizontally increasing angle of convergence when the action of the quadrupole lens becomes strong. When a dynamic voltage is applied to the electrodes forming the quadrupole lens, a star-tail shaped halo of a beam occurs in a horizontal direction, thereby lowering the resolution at the periphery of the screen. However, use of circular electrodes leads to an effect of adjusting horizontal focus aberration, thereby preventing horizontal halo of beams at the periphery of the screen, which is caused by an excessively increasing angle of horizontal convergence of the beams at the periphery of the screen. Also, since the dynamic focus voltage can be reduced by over 20% from the conventional dynamic focus voltage, the problems of circuit reliability and voltage resistance between electrodes of an electron gun can be solved, which is advantageous for electron gun assembly.

As described above, in the electron gun for a color CRT according to the present invention, when the cross section of an electron gun changed by the converging/diverging power by a first quadrupole lens is deflected by a nonuniform magnetic field of a deflection yoke, an excessive difference in the incidence angle due to a second quadrupole lens is compensated for by adjusting the incidence angle of horizontal and vertical beams incident onto a screen, thereby preventing enlargement of a horizontal halo of the electron beam and distortion of the beam. Also, the quadrupole effect is reinforced by increasing a quadrupole lens area of a beam in the second quadrupole lens, so that the quadrupole effect attained is greater than that in smaller quadrupole electron beam holes, thereby increasing assembling efficiency. Further, circular electron beam holes, rather than horizontally elongated electron beams, are formed on the second quadrupole lens, thereby suppressing a horizontal halo and preventing deterioration of focusing characteristics at the periphery of a phosphor screen. Thus, the electron beams can be made to have uniform cross sections throughout the entire phosphor screen, thereby improving the resolution of a picture.

While the present invention has been described in conjunction with the preferred embodiments disclosed, it will be apparent to those skilled in the art that various modifications and variations can be made within the spirit or scope of the invention defined in the appended claims.

What is claimed is:

1. An electron gun for a color cathode ray tube comprising:

cathodes, a control electrode, and a screen electrode, together forming a triode;

first and second focusing electrodes sequentially located relative to the screen electrode, a third focusing electrode having horizontally elongated electron beam holes on an exit side, and a fourth focusing electrode having vertically and horizontally elongated electron beam holes on entrance and exit sides, respectively; and a fifth focusing electrode, located adjacent to the fourth focusing electrode and having vertically elongated electron beam holes, and a final accelerating electrode located adjacent to the fifth focusing electrode, the fifth focusing electrode and the final accelerating electrode forming a main lens, wherein a static voltage is applied to the screen electrode and the second focusing electrode, a focus voltage is applied to the first, third, and fifth focusing electrodes, and a parabola dynamic focus voltage, synchronized with a deflection signal, is applied to the fourth focus electrode and a sixth focusing electrode.

2. An electron gun for a color cathode ray tube comprising:

cathodes, a control electrode, and a screen electrode, together forming a triode;

first and second focusing electrodes sequentially located relative to the screen electrode, a third focusing electrode having horizontally elongated electron beam holes on an exit side, and fourth focusing electrode having vertically and horizontally elongated electron beam holes on entrance and exit sides, respectively; and a fifth focusing electrode, located adjacent to the fourth focusing electrode and having vertically elongated electron beam holes, a sixth focusing electrode, located adjacent to the fifth focusing electrode and having vertically elongated electron beam holes on an entrance side, and a final accelerating electrode located adjacent to the sixth focusing electrode, wherein a static voltage is applied to the screen electrode and the second focusing electrode, a focus voltage is applied to the first, third, and fifth focusing electrodes, and a parabola dynamic focus voltage, synchronized with a deflection signal, is applied to the fourth focus electrode and the sixth focusing electrode.

3. An electron gun for a color cathode ray tube comprising:

cathodes, a control electrode, and a screen electrode, together forming a triode;

first, second, third, and fourth focusing electrodes, sequentially located relative to the screen electrode and forming at least one first quadrupole lens;

fifth and sixth focusing electrodes, located adjacent to the fourth focusing electrode and forming at least one second quadrupole lens; and a final accelerating electrode, located adjacent to the sixth focusing electrode and forming a main lens.

4. The electron gun according to claim 3, wherein the first quadrupole lens includes horizontally elongated electron beam holes on an exit side of the third focusing electrode.

5. The electron gun according to claim 3, wherein the first quadrupole lens includes vertically elongated electron beam holes on an entrance side of the fourth focusing electrode.

6. The electron gun according to claim 3, wherein the second quadrupole lens includes horizontally elongated electron beam holes on an exit side of the fourth focusing electrode, vertically elongated electron beam holes in the fifth focusing electrode, and circular electron beam holes on an entrance side of the sixth focusing electrode.

7. The electron gun according to claim 3, wherein the second quadrupole lens includes horizontally elongated electron beam holes on an exit side of the fourth focusing electrode, vertically elongated electron beam holes in the fifth focusing electrode, and vertically elongated electron beam holes on an entrance side of the sixth focusing electrode.

8. The electron gun according to claim 3, wherein the second quadrupole lens includes circular electron beam holes on an exit side of the fourth focusing electrode, vertically elongated electron beam holes in the fifth focusing electrode, and circular electron beam holes on an entrance side of the sixth focusing electrode.

* * * * *